US006554269B1

(12) United States Patent
Dobbertin et al.

(10) Patent No.: US 6,554,269 B1
(45) Date of Patent: Apr. 29, 2003

(54) AIRKNIFE AND VACUUM CONTROL CHANGES TO IMPROVE SHEET ACQUISITION FOR A VACUUM CORRUGATED FEED SUPPLY

(75) Inventors: Michael T. Dobbertin, Honeoye, NY (US); Thomas K. Sciurba, Webster, NY (US)

(73) Assignee: Heidelberger Druckmashinen AG, Heidelberg (DE)

( * ) Notice: Subject to any disclaimer, the term of this patent is extended or adjusted under 35 U.S.C. 154(b) by 0 days.

(21) Appl. No.: 09/688,000

(22) Filed: Oct. 14, 2000

(51) Int. Cl.[7] ..... B65H 3/12
(52) U.S. Cl. ..... 271/90
(58) Field of Search ..... 271/90, 97, 98, 271/105, 106, 108; 400/627; 414/797; 220/1.01

(56) References Cited

U.S. PATENT DOCUMENTS 3,989,237 A * 11/1976 Goff et al. ..... 271/120
4,011,978 A * 3/1977 Lehmacher et al. ..... 226/142
4,235,550 A * 11/1980 Case ..... 399/177
4,270,746 A * 6/1981 Hamlin ..... 271/106
4,273,439 A * 6/1981 Markham et al. ..... 399/87
4,297,025 A * 10/1981 Bach et al. ..... 271/289
4,305,567 A * 12/1981 Lunt ..... 251/214
4,313,599 A * 2/1982 Lohr ..... 271/166
4,327,878 A * 5/1982 Fauchier et al. ..... 502/60
4,336,929 A * 6/1982 Hanzlik ..... 271/106
4,361,317 A * 11/1982 Lapp-Emden ..... 271/106
4,502,778 A * 3/1985 Dodge et al. ..... 399/30
4,627,605 A * 12/1986 Roller et al. ..... 271/161
4,887,805 A * 12/1989 Herbert et al. ..... 271/208
4,893,322 A * 1/1990 Hellmick et al. ..... 378/165
5,317,619 A * 5/1994 Hellmick et al. ..... 378/173
5,334,133 A * 8/1994 Carroll ..... 128/870
5,634,634 A * 6/1997 Dobbertin et al. ..... 271/104
5,751,599 A * 5/1998 Bortnik et al. ..... 137/5
5,876,030 A * 3/1999 Dobbertin et al. ..... 271/104
5,893,554 A * 4/1999 Okahashi et al. ..... 271/104

* cited by examiner

*Primary Examiner*—Donald P. Walsh
*Assistant Examiner*—Kenneth W Bower
(74) *Attorney, Agent, or Firm*—Kathleen K. Bowen

(57) ABSTRACT

A method of operating a vacuum corrugated belt feeder, which may or may not have a positive air pressure separator, during non-feed cycle time. "The result being" to separate a sheet from a sheet supply stack, which method comprises agitating the top sheets in the stack by actuating the vacuum and/or the positive air pressure separator during non-feed cycle time.

7 Claims, 6 Drawing Sheets

AIRKNIFE AND VACUUM CONTROL CHANGES TO IMPROVE SHEET ACQUISITION FOR A VACUUM CORRUGATED FEED SUPPLY

BACKGROUND

The present invention is in the field of printers and copiers. More specifically this invention relates to a receiver sheet supply and feed apparatus, including a vacuum corrugated feeder, and which may have a positive air pressure separator on such printers and copiers. This invention is useful for the apparatus described by the U.S. Pat. No. 5,344,133 "Vacuum belt feeder having a positive air pressure separator and method of using a vacuum belt feeder " by Jantsch et al, which patent is hereby incorporated by reference in its entirety. The incorporated patent refers to a vacuum, a first positive air supply, and a second positive air supply. The first and second positive air supplies are used simultaneously and will herein be referred to collectively as the airknife.

In typical reproduction apparatus such as copiers or printers, information is reproduced on individual cut sheets of receiver material such as plain bond paper or transparencies. Such receiver sheets are stored in a stack and fed individually when copies are to be produced. The sheet feeder for the reproduction apparatus must be able to handle a wide range of sheet types and sizes reliably and without damage. Sheets must be fed individually, without misfeeds or multi-feeds.

The vacuum belt feeder described in the incorporated patent is useful for separating the top sheet from a sheet supply stack during the feed cycle. Typically the airflow and vacuum levels and associated timing are dictated by the highest feed rate required from a supply, i.e. one feed every image frame from the same supply. Frequently, this is not the operating mode. For instance, for cover and slipsheet insertion, there are generally a number of 'body' sheets fed between insert sheets. Likewise, many printers operate in "interleave" mode when printing duplex whereby every other feed comes from the paper supply interleaved with sheets from the duplex path. In these and similar cases, a method is desired which will separate the top sheet from the sheet supply stack when it is not the feed cycle and thus improve the probability of feeding the next sheet when desired.

SUMMARY OF THE INVENTION

A method of operating a vacuum corrugated belt feeder, which may have a positive air pressure separator, during non-feed cycle time so as to separate a sheet from a sheet supply stack, which method comprises agitating the top sheets in the stack by actuating the vacuum and/or the positive air pressure separator during non-feed cycle time.

DETAILED DESCRIPTION

The U.S. Pat. No. 5,344,133 "Vacuum belt feeder having a positive air pressure separator and method of using a vacuum belt feeder " by Jantsch et al, describes an apparatus which uses both vacuum and positive air pressure to separate and acquire the top sheet of a supply stack. In this invention, both the vacuum line and the positive air pressure line are routed through valves, which valves are used to control the flow of vacuum and positive pressure air. During typical operation of a printer/copier which uses the apparatus described in U.S. Pat. No. 5,344,133, both the vacuum valve and the positive air pressure valve are open during the feed cycle, and closed when the printer/copier is not feeding from that particular supply. When using large format receivers (e.g. 11×17), duplex printing, or multiple supplies (e.g. body paper, covers and inserts) there are image frames in which no feed is required from a given supply. There is an opportunity to use this time to improve the feed reliability of the next sheet to be fed from that supply. Accordingly the present invention discloses several ways in which this can be accomplished.

Following is a detailed description of the drawings which show the vacuum belt feeder with positive air pressure separator as described in U.S. Pat. No. 5,344,133. Although this system is described in detail, the present invention is not limited to use in this particular system. Any printer/copier which uses a combination of vacuum and positive air pressure to lift and separate the top sheets from a feed stack may make use of this invention. This invention may also be used in a printer/copier with no positive air pressure system, in which case the change would be just to the control of the vacuum.

The detailed description is written to a top feed vacuum corrugated feed device, but the present invention is also useful for a bottom feed vacuum belt feed device. In the case of a bottom feed device, instead of separating the top sheet, the vacuum with or without the airknife would be separating the bottom sheet.

Figure 1:
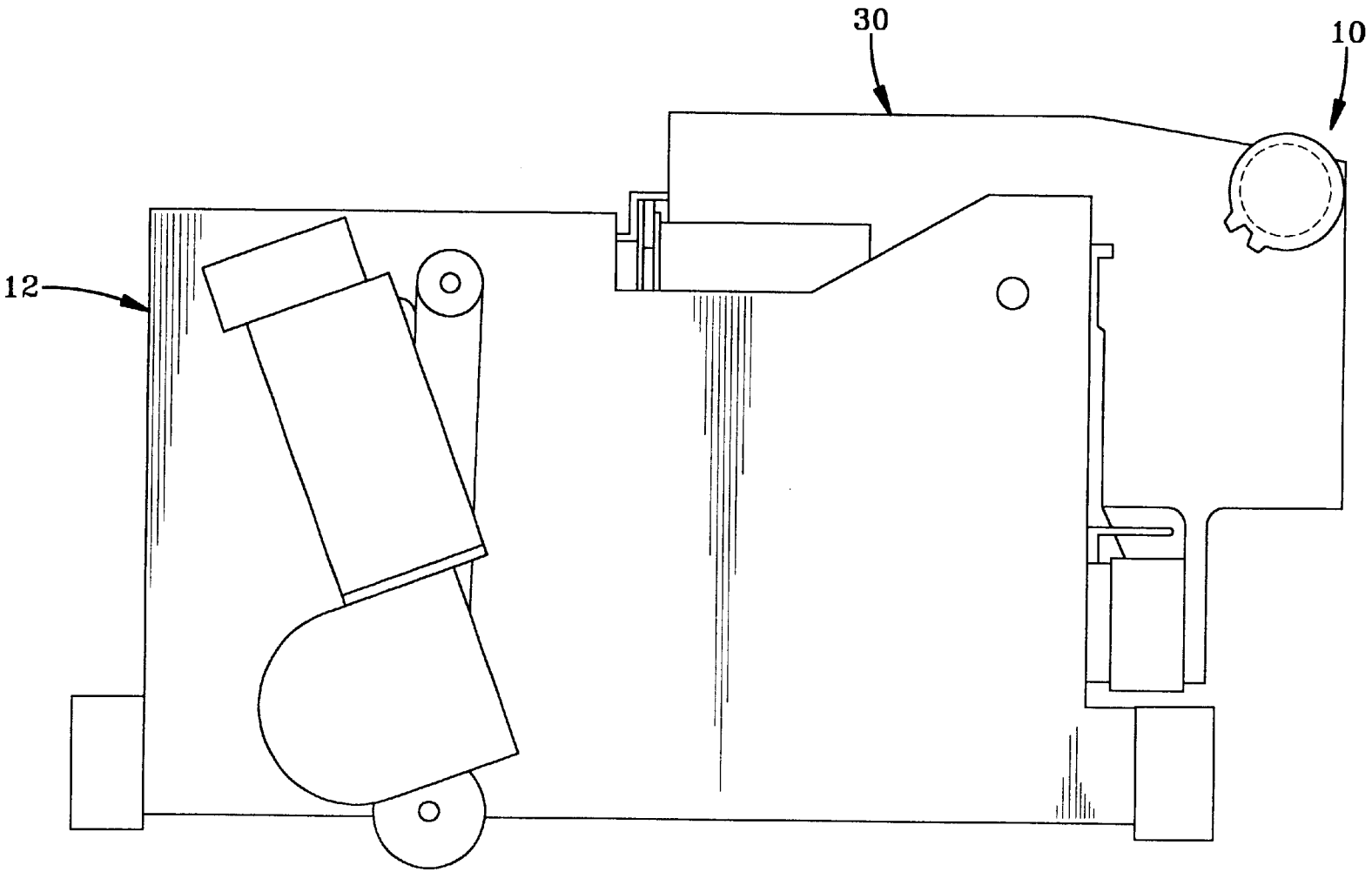
FIG. 1 is a side view of a receiver sheet supply and feeding apparatus.
Figure 2:
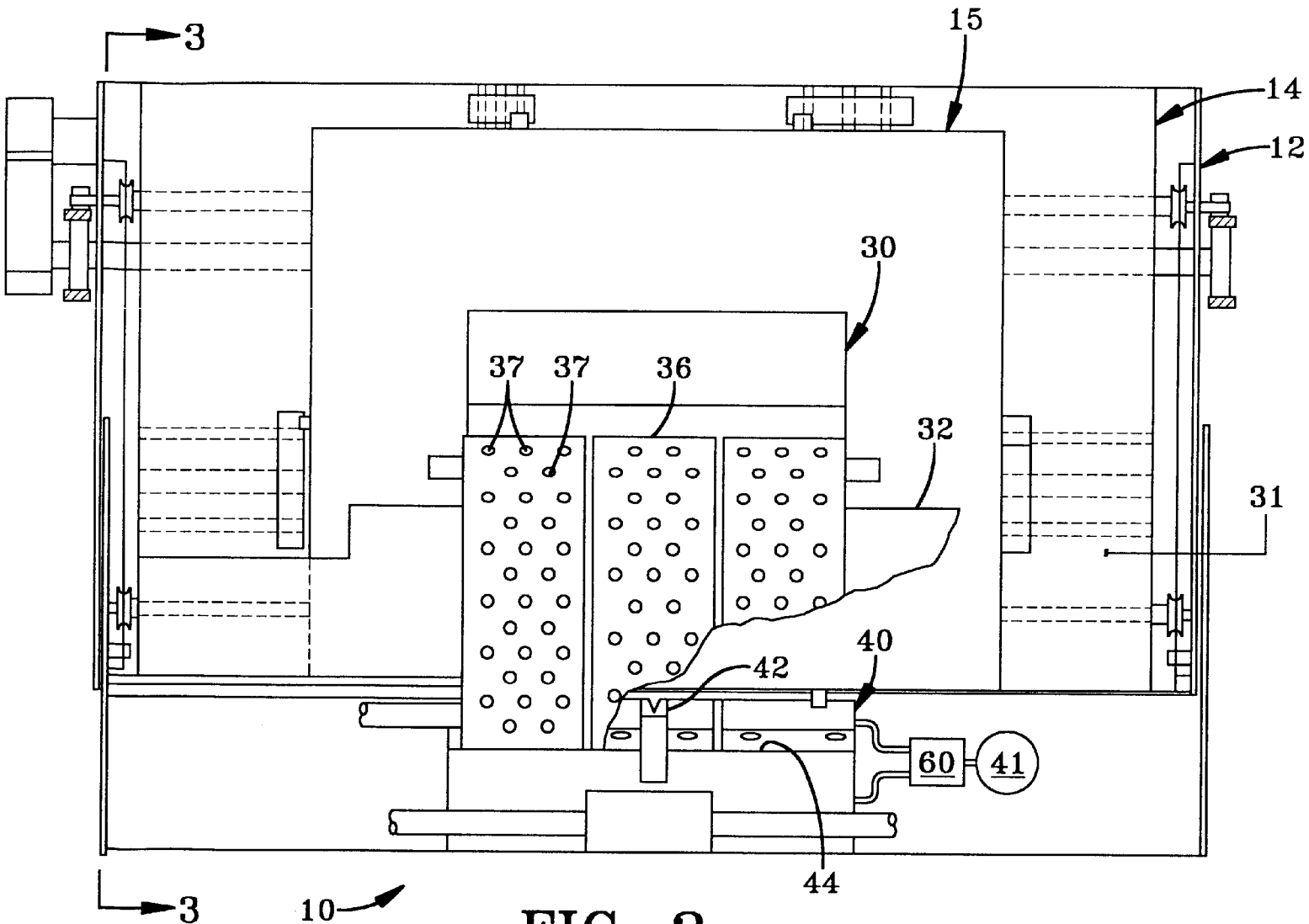
FIG. 2 is a top plan view of a receiver sheet supply and feeding apparatus of FIG. 1 with portions removed or broken away to facilitate viewing
Figure 3:
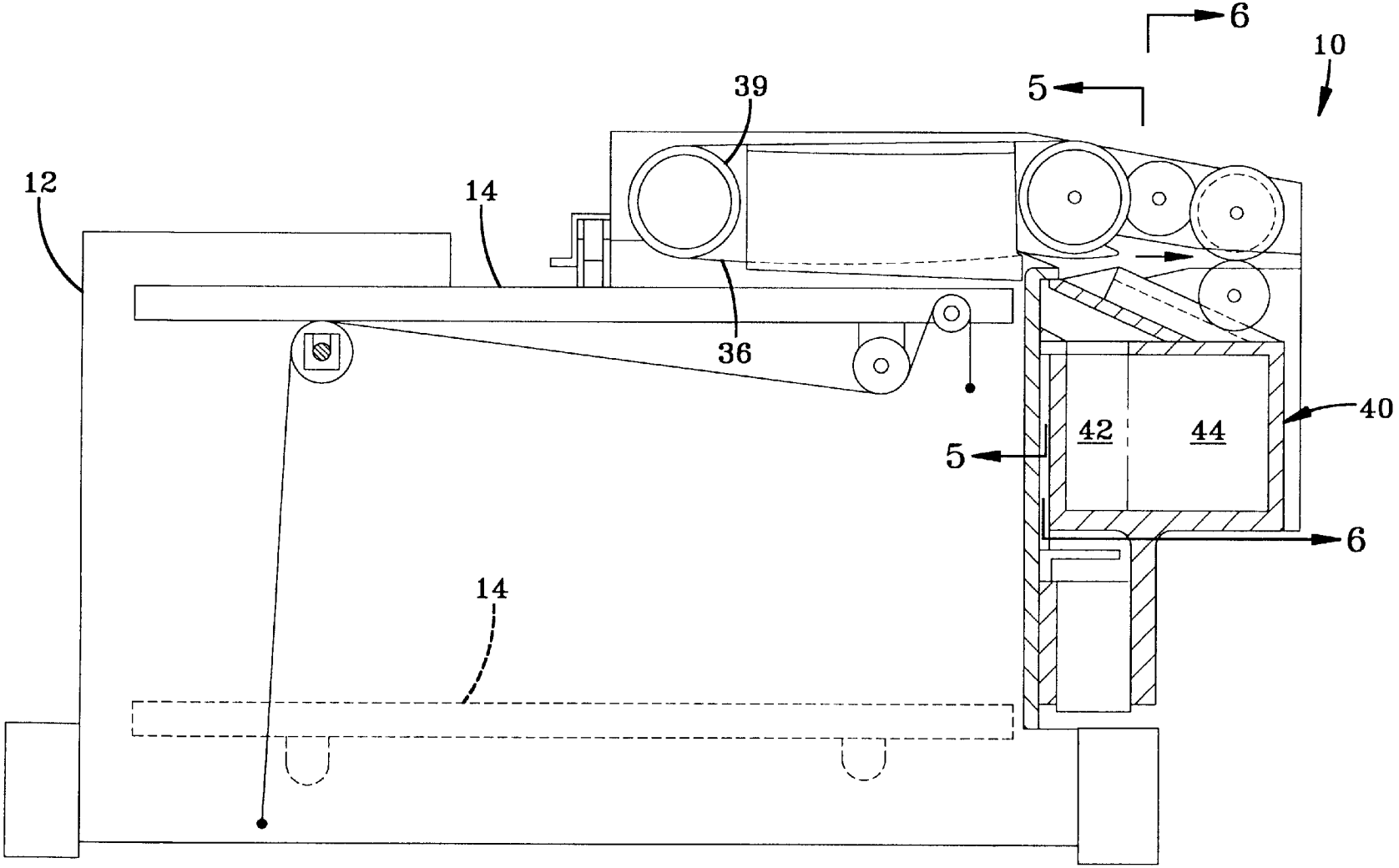
FIG. 3 is a side view of a cross-section of a receiver sheet supply and feeding apparatus taken along lines 3—3 of FIG. 2.
Figure 4:
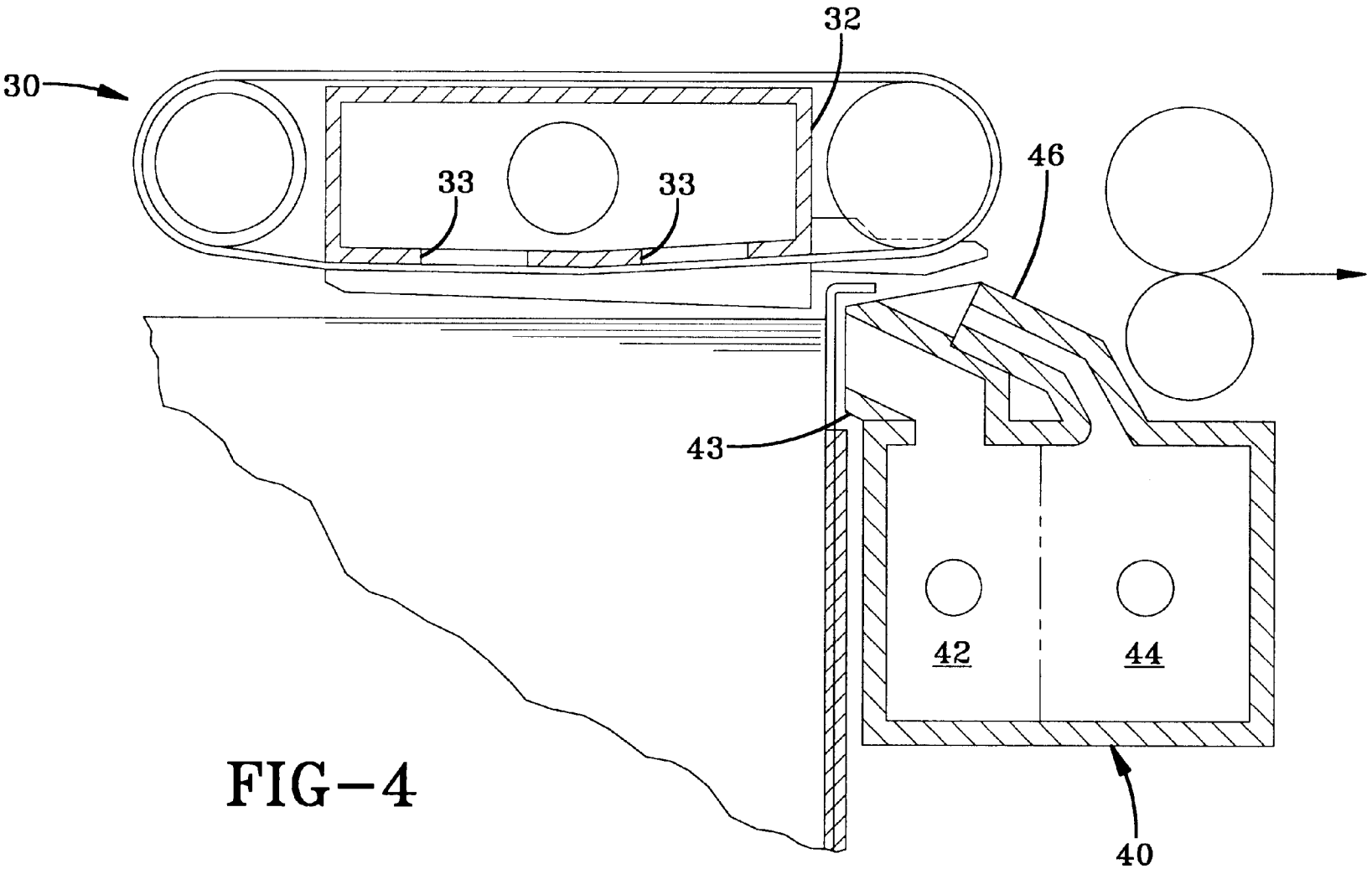
FIG. 4 is a side cross-sectional view of a portion of a receiver sheet supply and feeding apparatus.
Figure 5:
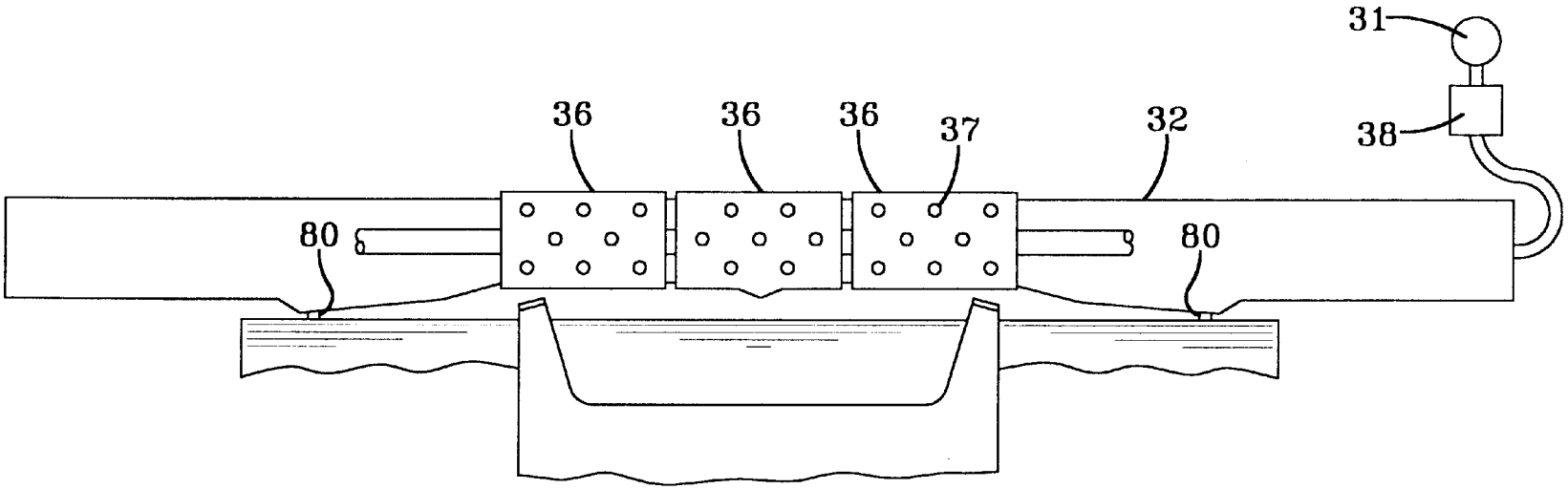
FIG. 5 is an end view of a portion of the receiver sheet supply and feeding apparatus, taken along the lines 5—5 of FIG. 3.
Figure 6:
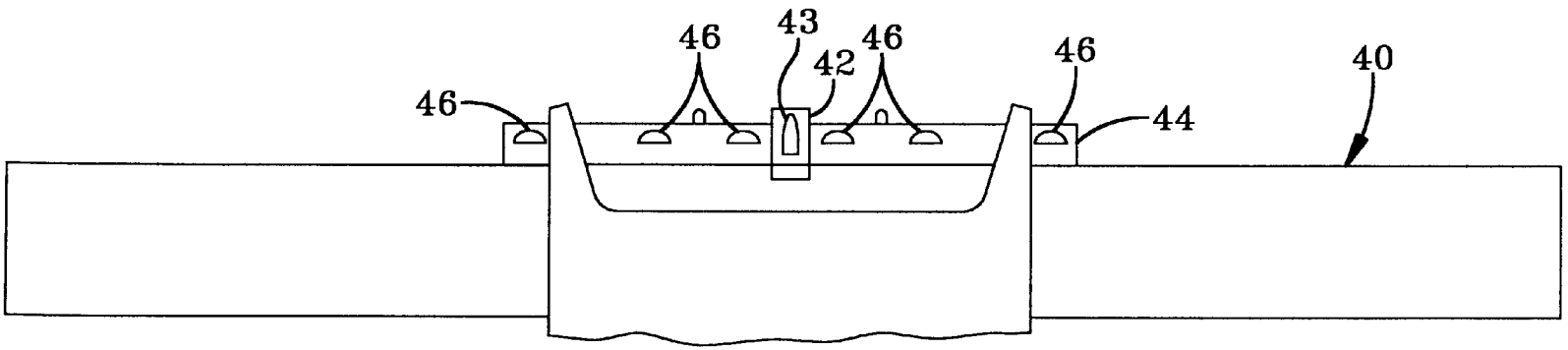
FIG. 6 is an end view of a portion of the receiver sheet supply and feeding apparatus, taken along the lines 6—6 of FIG. 3.
Figure 7:
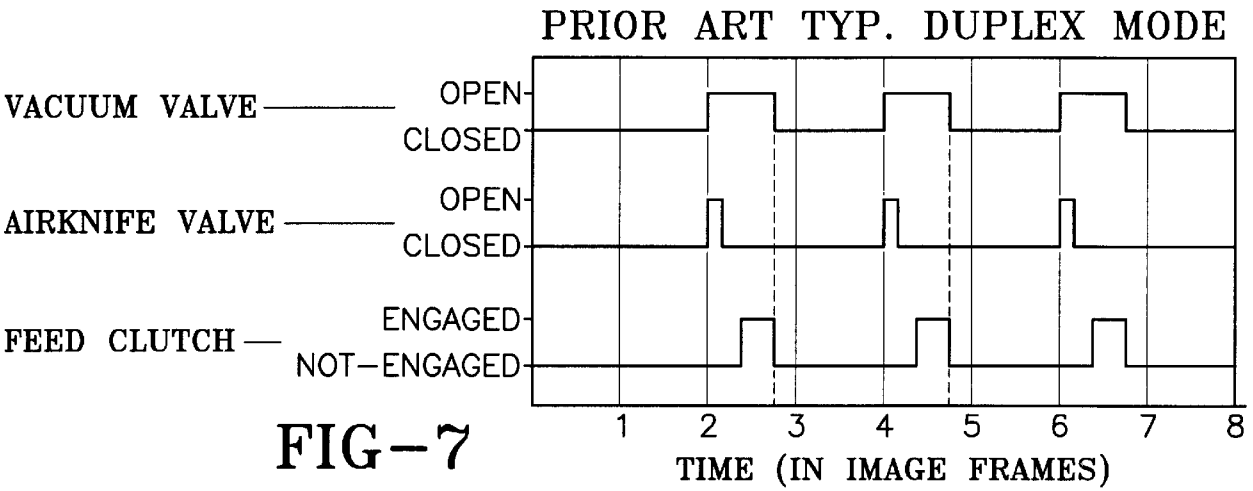
FIG. 7 is a timing diagram according one aspect of the invention.
Figure 8:
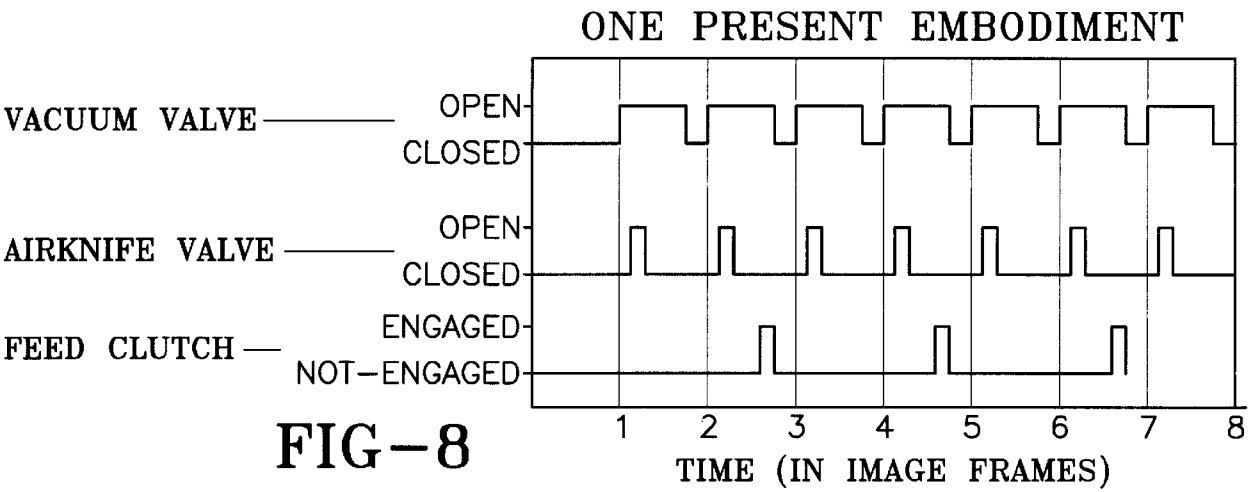
FIG. 8 is a timing diagram according to one aspect of the invention.

Various aspects of the invention are presented in FIGS. 1–6 which are not drawn to scale and in which like components are numbered alike. Referring now to FIGS. 1–2, a receiver sheet supply and feeding apparatus are shown. The receiver sheet supply and feeding apparatus designated generally by the numeral 10, includes an open hopper 12 and an elevating platform 14 for supporting a stack of sheets. A sheet stack 15 supported on the platform 14 contains individual sheets suitable for serving as receiver sheets for having reproductions formed thereon in a copier or printer device.

The sheet stack-supporting platform 14 is supported within the hopper 12 for substantially vertical elevational movement by a lifting mechanism. The lifting mechanism serves to raise the platform 14 to an elevation for maintaining the topmost sheet in the stack at a predetermined level during operation. Maintaining the topmost sheet at the predetermined level is accomplished by a sheet detection switch 80 (see FIG. 5), or multiple switches, which controls the operation of a motor for actuating the lifting mechanism to raise the platform until a switch or switches is activated.

A sheet feed head assembly 30 is located in association with the hopper 12 so as to extend over a portion of the platform 14 in spaced relation to a sheet stack 15 supported thereon. The sheet feed head assembly 30 includes a ported plenum 32 connected to a vacuum source 31, and an airknife 40 connected to a positive pressure air source 41. A positive pressure airjet from the airknife 40 levitates the top sheets in the supported sheet stack 15. Vacuum at the plenum 32 is effective through the plenum ports 33 to cause the topmost levitated sheet from the stack to thereafter be acquired at the plenum 32 for separation from the sheet stack 15. This adheres the topmost sheet to the belt 36 via the belt ports 37. Additional positive air pressure jets from the airknife 40 assure separation of subsequent sheets from the acquired topmost sheet.

A vacuum valve 38 (see FIG. 5) is used to control the operation of the vacuum. Thus during a feed cycle, the valve will be open so as to levitate the top sheet in the stack. In a preferred method of operation, the opening and closing of the vacuum valve is timing based, however, valve operation may also be controlled by other methods, such as a pressure or a mechanically activated switch. For example, a switch may be attached to the plenum 32 to detect when a sheet has been acquired. A signal provided by the switch on detection of sheet acquisition may be utilized to control operation of various components of the sheet feed head assembly 30, such as timing of activations or setting of air flow levels, to optimize operation for a particular type (size) of sheet to be fed from the sheet supply and feeding mechanism 10. When the vacuum is said to be "actuated", this means that the vacuum valve 38 is open. When the vacuum is said to be "de-actuated" this means that the vacuum valve 38 is closed.

The airknife 40 comprises a first air jet arrangement 42 and a second air jet arrangement 44. The first air jet arrangement incorporates a single nozzle 43 in fluid communication with a source of positive pressure air 41, for example a range of 4–10 inwg in certain embodiments. The chambers which are part of the first air jet arrangement 42 and the second air jet arrangement 44 may be separate chambers, or may be combined into one larger chamber. The nozzle 43 directs a positive pressure air stream at the sheet stack, in the center of the lead edge, to fluff the top sheets in the stack to bring the topmost sheet into association with the sheet feed head assembly 30 where it can be acquired by vacuum, at the plenum 32.

The second air jet arrangement 44 incorporates a plurality of nozzles 46 in fluid communication with the source of positive pressure air 41. The nozzles 46 are aimed slightly above the aim point for the first air jet nozzle 43. The purpose of the second air jet arrangement 44 is to separate any sheets adhering to the topmost sheet acquired by the sheet feed head assembly 30.

A positive pressure air valve 60 is used to control the flow of positive pressure air through the airknife 40. When the positive air pressure separator 40 is actuated, this means the positive air pressure valve 60 is open. When the positive air pressure separator 40 is de-actuated, this means the positive air pressure valve 60 is closed. However, when the positive air pressure valve 60 is closed, that does not necessarily mean that there is no positive pressure airflow. In a preferred design, the positive air pressure valve 60 allows some airflow even when closed (does not close all the way). One commonly used valve design allows about one third of the airflow through an open valve to flow through when the valve is 'closed'.

The following description of the drawings describes embodiments of a method for operating a vacuum belt feeder with a positive pressure air separator. As mentioned earlier however, this invention is not limited to a vacuum belt feeder with a positive air pressure separator, but may be used on a vacuum belt feeder with no positive air pressure separator as well. If this invention were used on a vacuum belt feeder with no positive air pressure separator, the method would be the same, except that where the description states that both the vacuum and the positive air pressure separator are actuated, only the vacuum would be actuated.

According to an aspect of the invention, a method of operating a vacuum belt feeder with positive air pressure separator during non-feed cycle time so as to separate a sheet from a sheet supply stack 15, comprises agitating the top sheets in the sheet supply stack 15 by actuating the vacuum and the positive air pressure separator 40.

In one embodiment of the invention, the vacuum and airknife 40 (positive air pressure separator) remain actuated until the feed cycle begins. When the feed cycle begins, the vacuum and airknife 40 revert to the feed cycle control sequence.

In a preferred embodiment of the invention, the vacuum and airknife 40 (positive air pressure separator) are actuated and de-actuated every frame as if the supply were feeding, but the belt feeder is not engaged. Once again, when the feed cycle begins, the vacuum and the airknife 40 revert back to the feed cycle control sequence.

In a further preferred embodiment, the vacuum and the positive air pressure separator 40 are actuated for the frame immediately following the last feed, de-actuated, and then not actuated again until the feed cycle begins.

According to a further embodiment, the vacuum and the positive air pressure separator 40 are actuated at least one frame during non-feed cycle time, but not every frame. Another embodiment of this method is to identify the impending feed, and actuate the vacuum and the positive air pressure separator 40 during the last frame before the impending feed begins.

What is claimed is:

1. An improved method of operating a feeder of sheets that comprises the steps; moving a sheet from a sheet supply stack to a first position; moving the sheet to a second position; the improvement comprising:

moving the sheet at least partially from the sheet supply stack;

replacing the sheet on the sheet supply stack, wherein the improved steps are carried out for the purpose of loosening the sheet from the sheet supply stack to insure that only one sheet is moved to the second position, and are carried out at a time when the known steps are not in process.

2. The method of claim 1 wherein said sheet is moved and replaced on the sheet supply stack by actuating and deactuating a vacuum.

3. The method of claim 1 wherein said sheet is moved and replaced on the sheet supply stack by actuating and deactuating a vacuum and a positive air pressure separator.

4. The method of claim 1 wherein said sheet is moved and replaced on the sheet supply stack by actuating and deactuating a positive air pressure separator.

5. The method of claim 1 wherein the improved steps are carried out immediately following the known steps.

6. The method of claim 1 wherein the improved steps are carried out at least once between each set of known steps.

7. The method of claim 1 wherein the known steps are impending, and wherein said improved steps are carried out immediately before the known steps begin.

* * * * *